US009962586B2

(12) United States Patent
Bonventre et al.

(10) Patent No.: US 9,962,586 B2
(45) Date of Patent: May 8, 2018

(54) ANGLED BOARD AND METHODS OF PLAYING THE SAME

(71) Applicant: SHORE CREATION LLC, Center Moriches, NY (US)

(72) Inventors: Joshua David Bonventre, Center Moriches, NY (US); Kevin Bruce Texeira, Auburn, NY (US)

(73) Assignee: SHORE CREATIONS LLC, Center Moriches, NY (US)

( * ) Notice: Subject to any disclaimer, the term of this patent is extended or adjusted under 35 U.S.C. 154(b) by 130 days.

(21) Appl. No.: 14/592,683

(22) Filed: Jan. 8, 2015

(65) Prior Publication Data

US 2015/0190695 A1 Jul. 9, 2015

Related U.S. Application Data

(60) Provisional application No. 61/925,007, filed on Jan. 8, 2014.

(51) Int. Cl.
*A63B 63/00* (2006.01)
*F41J 1/00* (2006.01)
(Continued)

(52) U.S. Cl.
CPC ..... *A63B 67/06* (2013.01); *A63B 63/08* (2013.01); *A63B 69/0053* (2013.01);
(Continued)

(58) Field of Classification Search
CPC ... A63F 9/02; A63F 1/18; A63B 67/10; A63B 67/06; A63B 63/08; A63B 63/00
(Continued)

(56) References Cited

U.S. PATENT DOCUMENTS 2,021,989 A 11/1935 De Master
3,672,676 A * 6/1972 Goldfarb ..... A63B 67/10 273/331
(Continued)

FOREIGN PATENT DOCUMENTS

WO 2008025946 3/2008

OTHER PUBLICATIONS

Website: http://www.americansale.com/bean_bag_rules_.aspx Bean Bag toss Game Rules (2013) 3 pages.
(Continued)

*Primary Examiner* — Gene Kim
*Assistant Examiner* — Christopher Glenn
(74) *Attorney, Agent, or Firm* — Tarter Krinsky & Drogin LLP

(57) ABSTRACT

Exemplary embodiments of an angled board and methods of playing an angled board are provided. In one embodiment, an angled board can be provided having a base portion having a support, a top surface on the base portion having an opening, wherein the top surface is configured to allow a ball to bounce off the top surface, and a slanted board provided proximate to a first end of the top surface, the slanted board being provided at an angle with respect to the top surface. The top surface can have an upper portion and a lower portion, where a net can be provided within a receptacle between the upper and lower portions. One or more ridges can be provided along the upper and lower portions of the top surface that extend upward from the top surface.

22 Claims, 5 Drawing Sheets

(51) Int. Cl.

| | |
|---|---|
| ***F41J 3/00*** | (2006.01) |
| ***A63B 67/06*** | (2006.01) |
| ***A63B 63/08*** | (2006.01) |
| ***A63B 69/00*** | (2006.01) |
| *A63B 71/06* | (2006.01) |
| *A63B 24/00* | (2006.01) |

(52) U.S. Cl.
CPC ... *A63B 71/0669* (2013.01); *A63B 2024/0037* (2013.01); *A63B 2071/0625* (2013.01); *A63B 2207/00* (2013.01); *A63B 2209/08* (2013.01); *A63B 2209/10* (2013.01); *A63B 2220/801* (2013.01); *A63B 2220/803* (2013.01)

(58) Field of Classification Search
USPC ..... 273/400, 331, 402
See application file for complete search history.

(56) References Cited

U.S. PATENT DOCUMENTS

| | | | | | |
|---|---|---|---|---|---|
| 4,012,042 | A * | 3/1977 | Blasingame | A63B 63/08 | 273/401 |
| 4,709,929 | A * | 12/1987 | Mills | A63B 63/08 | 273/402 |
| 4,961,586 | A * | 10/1990 | Conville | A63B 67/06 | 273/402 |
| 4,968,041 | A * | 11/1990 | Calvo | A63B 67/06 | 273/401 |
| 5,123,656 | A | 6/1992 | Green | | |
| D375,125 | S | 10/1996 | Mallek et al. | | |
| 5,566,948 | A * | 10/1996 | Kidd | A63B 63/08 | 273/342 |
| 6,932,345 | B1 | 8/2005 | O'Dell | | |
| 7,056,239 | B2 | 6/2006 | Hickman, Jr. | | |
| 7,121,966 | B2 | 10/2006 | Fitzmaurice | | |
| 7,237,777 | B2 | 7/2007 | Digges, III et al. | | |
| 7,607,666 | B1 * | 10/2009 | Studier | A63B 63/00 | 116/222 |
| D621,881 | S * | 8/2010 | Youngberg | D21/303 | |
| 8,435,142 | B2 | 5/2013 | Gibson | | |
| 2005/0023762 | A1 | 2/2005 | Greiwe et al. | | |
| 2005/0051968 | A1 | 3/2005 | Froesel | | |
| 2005/0127609 | A1 | 6/2005 | Raslowsky | | |
| 2010/0292033 | A1 | 11/2010 | Sarver | | |
| 2012/0065004 | A1 | 3/2012 | Blackwell | | |
| 2013/0023359 | A1 | 1/2013 | Goodman | | |
| 2013/0082442 | A1 | 4/2013 | Hanel | | |

OTHER PUBLICATIONS

Website: http://www.cornholegame.org/standardsandrules.php
Corn Toss Game Association (2013), 4 pages.
Website: http://www.woodgamz.com/cornholegallery.html
Cornhole Gallery—Cornhole: woodgamz.com (2005), 15 pages.

* cited by examiner

ANGLED BOARD AND METHODS OF PLAYING THE SAME

CROSS-REFERENCE TO RELATED APPLICATIONS

This application relates to and claims priority from U.S. Provisional Patent Application Ser. No. 61/925,007 filed Jan. 8, 2014, the entire disclosure of which is hereby incorporated herein by reference.

FIELD OF THE DISCLOSURE

The present disclosure relates to exemplary embodiments of an angled board, and more particularly, to exemplary embodiments of an angled board having a net, including methods of playing the angled board.

BACKGROUND OF THE DISCLOSURE

Games involving physical skills or player performance can be challenging and provide satisfaction and enjoyment as players' skills and performance are tested consistently. In particular, game designs that involve throwing or catching skills help to exercise players, improve player hand-eye coordination, and practice and improve tossing and catching skills. However, many designs of throwing and catching games do not provide portability or multiplayer capability, and do not allow for various skill levels or provide various scoring opportunities.

At least one of the objects of the exemplary embodiments of the present disclosure is to reduce or address the deficiencies and/or limitations described herein above, by providing an angled board game that allows for multiplayer capability does not suffer from these deficiencies.

SUMMARY OF THE DISCLOSURE

At least some of the above described problems can be addressed by exemplary embodiments of the apparatuses and methods according to the present disclosure. For example, using such exemplary embodiments, it is possible to provide an angled board, comprising a base portion having a support, a top surface on the base portion having an opening, wherein the top surface is configured to allow a ball to bounce off the top surface, and a slanted board provided proximate to a first end of the top surface, the slanted board being provided at an angle with respect to the top surface.

The top surface can further comprise an upper portion and a lower portion, wherein the receptacle is provided between the upper and lower portions. The angled board can further comprise one or more ridges provided along a width of the upper portion and the lower portion of the top surface, the one or more ridges extending upward from the top surface. The one or more ridges can have angled walls around a perimeter of the ridges. The upper portion and lower portions can each have five ridges. The angled board can further comprise a net provided within the receptacle and connected to the angled board. The angle can be between approximately 90 degrees and approximately 170 degrees, and can be approximately 135 degrees.

The base portion can further comprise one or more support legs supporting the top board at a second end opposite the first end of the top surface. The top surface, slanted board and base portion can comprise a single unitary piece. The top surface, slanted board and base portion can be made of plastic.

In some exemplary embodiments, a method of playing a game for multiple players can be provided, comprising providing a first angled board having a receptacle on a top surface, and a slanted board at a first front portion of the first angled board, providing a second angled board having a receptacle on a top surface, and a slanted board at a first front portion of the second angled board, the first and second angled boards facing each other, awarding one or more points to a first player on a first team located proximate the first angled board for throwing a ball into the receptacle of the second angled board, and awarding one or more points to a second player on the first team located proximate the second angled board for catching the ball if the ball bounces off the top surface or slanted board of the second angled board.

The method can further comprise awarding one or more points to a third player on a second team located proximate the first angled board for catching the ball if the ball bounces off the top surface or slanted board of the second angled board after the first player throws the ball. The method can further comprise deducting a throw from the first team if a third player on a second team located proximate the first angled board catches the ball if the ball bounces off the top surface or slanted board of the second angled board after the first player throws the ball. The method can further comprise awarding an extra throw to a second team if a third player on the second team located proximate the first angled board catches the ball if the ball bounces off the top surface or slanted board of the second angled board after the first player throws the ball.

The method can further comprise awarding three points to the first player on the first team for throwing the ball into the receptacle of the second angled board. The method can further comprise awarding one point to the second player on the first team for catching the ball if the ball bounces off the top surface or slanted board of the second angled board. The method can further comprise providing two attempts to throw the ball to the first player on the first team, then providing the second team two attempts to throw the ball into the first angled board. The method can further comprise awarding a win to the first team or the second team that reaches a certain number of points first.

In some exemplary embodiments, a package can be provided, comprising a first angled board comprising a base, a top surface on the base having an upper portion at a first end, a lower portion at a second end and a net provided within a receptacle between the upper and lower portions, one or more ridges provided along a width of the upper portion and the lower portion of the top surface, the one or more ridges extending upward from the top surface, a slanted board provided at the second end of the top surface, the slanted board being provided at an angle with respect to the top surface, and two support legs provided at a second end of the top surface, wherein the top surface and the slanted board are configured to allow a ball to bounce off their surface, a second angled board comprising a base, a top surface on the base having an upper portion at a first end, a lower portion at a second end and a net provided within a receptacle between the upper and lower portions, one or more ridges provided along a width of the upper portion and the lower portion of the top surface, the one or more ridges extending upward from the top surface, a slanted board provided at the second end of the top surface, the slanted board being provided at an angle with respect to the top surface, and two support legs provided at a second end of the top surface, wherein the top surface and the slanted board are configured to allow a ball to bounce off their surface, and one or more balls configured to bounce off the top surfaces and the slanted boards of the first and second angled boards.

These and other objects, features and advantages of the present disclosure will become apparent upon reading the following detailed description of embodiments of the present disclosure, when taken in conjunction with the appended claims. It should be understood that the detailed description and specific examples, while indicating the preferred or exemplary embodiments of the disclosure, are intended for purposes of illustration only and are not intended to limit the scope of the disclosure.

BRIEF DESCRIPTION OF THE DRAWINGS

The foregoing and other exemplary objects of the present disclosure will be apparent upon consideration of the following detailed description, taken in conjunction with the accompanying exemplary drawings and claims, in which like reference characters refer to like parts throughout, and in which:

Figure 1:
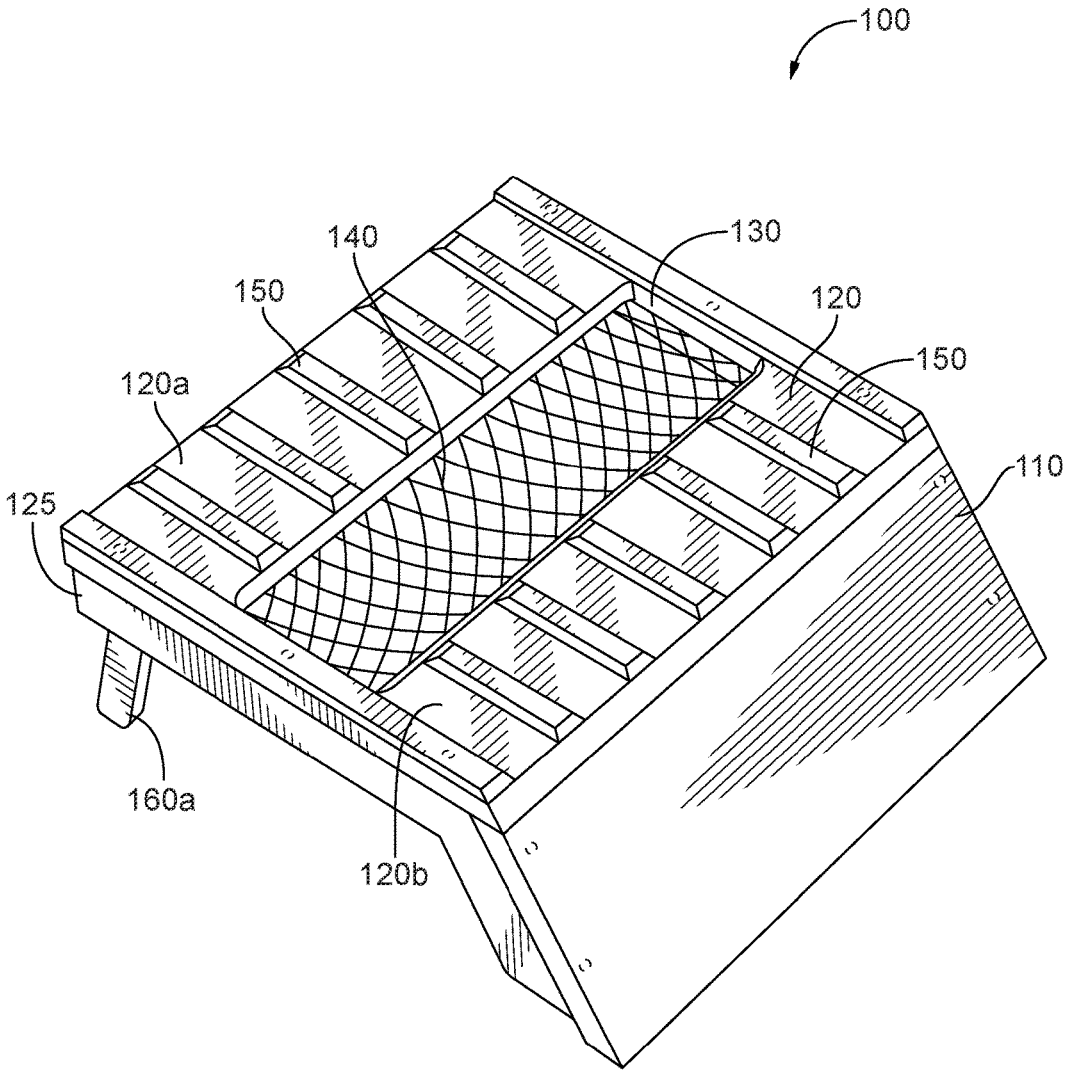
FIG. 1 is a perspective view of an angled board according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

Exemplary embodiments of the apparatuses and methods of the present disclosure will now be described with reference to the figures. The following description of the various embodiments is merely exemplary in nature and is in no way intended to limit the scope of the disclosure, its application, or uses.

FIG. 1 is a perspective view of an angled board 100 according to an exemplary embodiment of the present disclosure. The angled board 100 can have a top board 120, base 125 and slanted board 110. The top board 120 can be connected to or provided on a base 125, and a slanted board 110 can be provided along an edge of the top board 110. The slanted board 110 can be connected to the base 125 and top board 120. In some exemplary embodiments, the base 125 and slanted board 110 can be unitary or a single piece, as well as the top board 120. The top board 120 can have an upper portion 120*a* and a lower portion 120*b*, and a cutout portion 130 or receptacle having a net 140. The net 140 can be connected to the base 125 and/or or top board 120, and can be connected through any attachment mechanism, such as but not limited to hooks, pins, magnets, Velcro®, glue, and other various attachment mechanisms.

Figure 2:
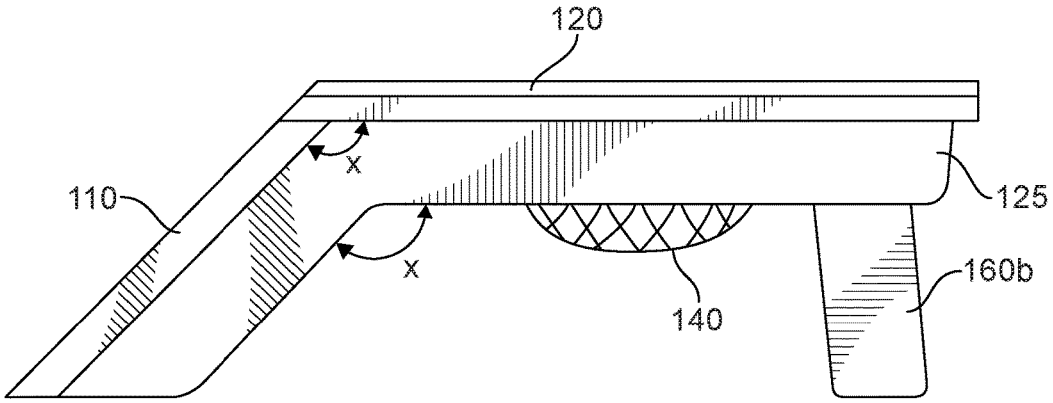
FIG. 2 is a first side view of an angled board according to an exemplary embodiment of the present disclosure.
Figure 3:
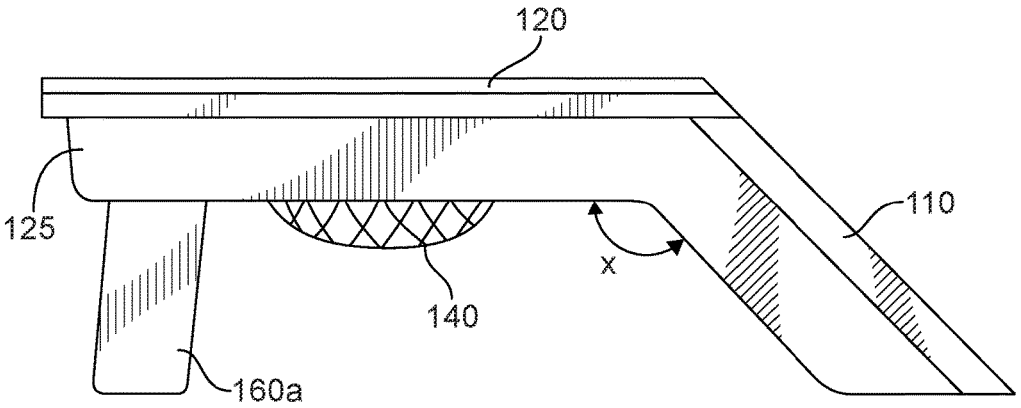
FIG. 3 is a second side view of an angled board according to an exemplary embodiment of the present disclosure.

As shown in FIGS. 2 and 3, which are opposite side views of an angled board according to an exemplary embodiment of the present disclosure, the base 125 can be angled at an angle x with respect to the top board 110, which can range from approximately 90 degrees to approximately 170 degrees, and is not limited to any particular angle. In some exemplary embodiments, the angle x can be approximately 135 degrees. The slanted board 110 can be provided on the base 125 and connected to the top board 120 at approximately the same angle x. The base 125 can provide support at a first side of the angled board 100, and support legs 160*a* and 160*b* can be provided for support at a second side of the angled board 100.

Figure 4:
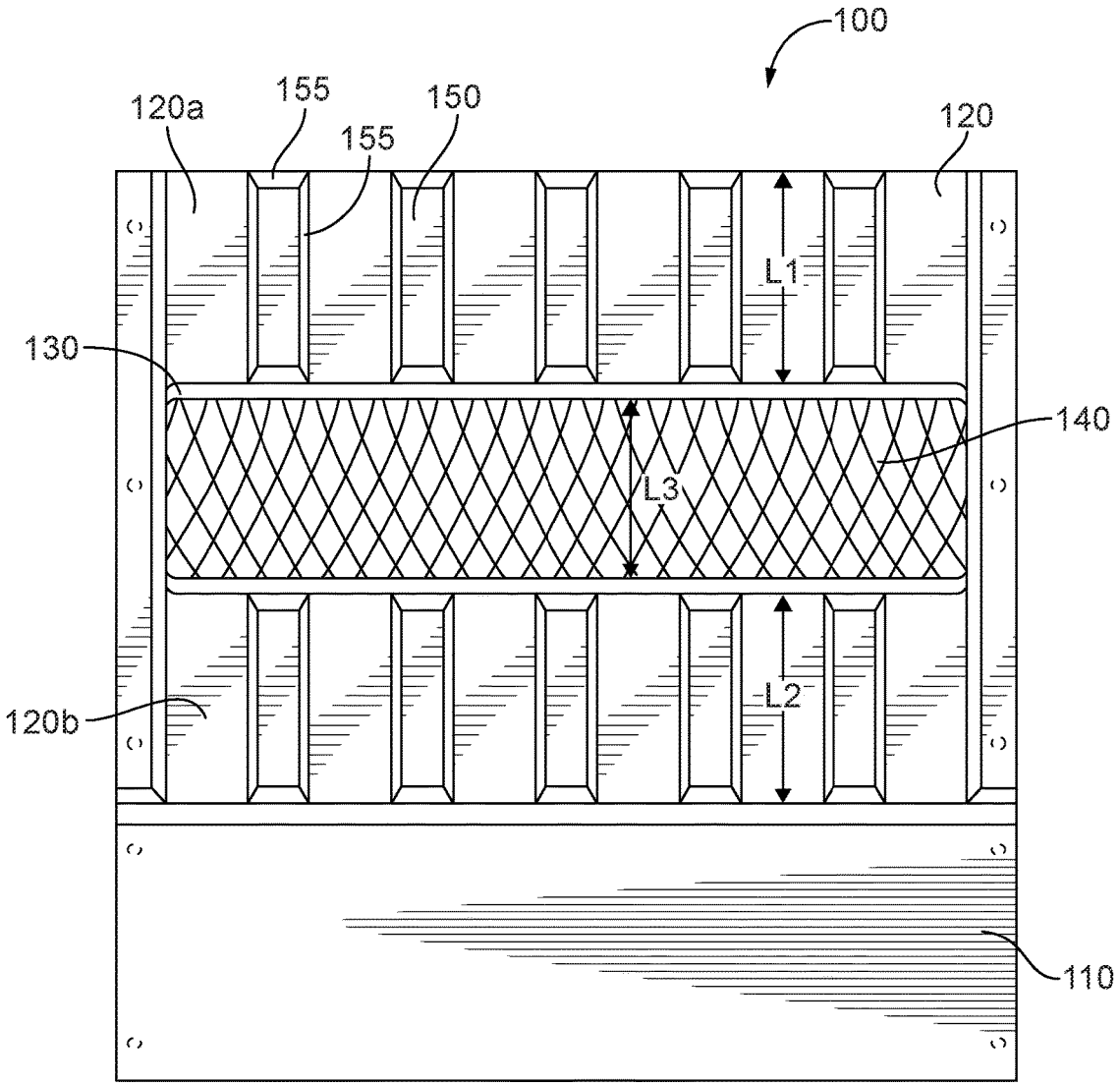
FIG. 4 is a top view of an angled board according to an exemplary embodiment of the present disclosure.

FIG. 4 is a top view of an angled board according to an exemplary embodiment of the present disclosure. As shown, the top board 120 can have an upper portion 120*a* and a lower portion 120*b*, with a cutout portion 130 in between. The cutout portion 130 can be an empty slot or hole, or can contain a net connected to the bottom of the cutout portion. The upper portion 120*a* can have a length L1 and the lower portion 120*b* can have a length L2 that can vary in length from approximately 1 inch to approximately 18 inches, and is not limited to any particular length. The upper portion 120*a* and lower portion 120*b* can have one or more ridges 150 that extend vertically upward from the top board 120, and can have angled walls 155 along the perimeter of the ridges 150 that protrude outward. The upper portion 120*a* and lower portion 120*b* can have any number of more ridges 150 and the angled board 100 is not limited to any particular number. In some embodiments, the upper portion 120*a* and lower portion 120*b* can have five ridges 150 along the respective width. The upper portion 120*a* and lower portion 120*b* can have an equal number of ridges or different number, and can have similar ridges in size, shape, number and location, and can correspond to each other, or can be different and can vary. Various embodiments of different types, sizes and numbers of ridges are contemplated by the exemplary embodiments of the present disclosure.

The cutout portion 130 can be provided along the width of the top board 120, and can have a length L3 that can range from approximately one inch to approximately 12 inches, and the length or width are not limited to any particular length or width. The cutout portion can be provided anywhere on the top board 120, and can be between the upper portion 120*a* and lower portion 120*b*, or further along either side. Various configurations of the cutout portion 130 are contemplated by the exemplary embodiments of the present disclosure.

Figure 5:
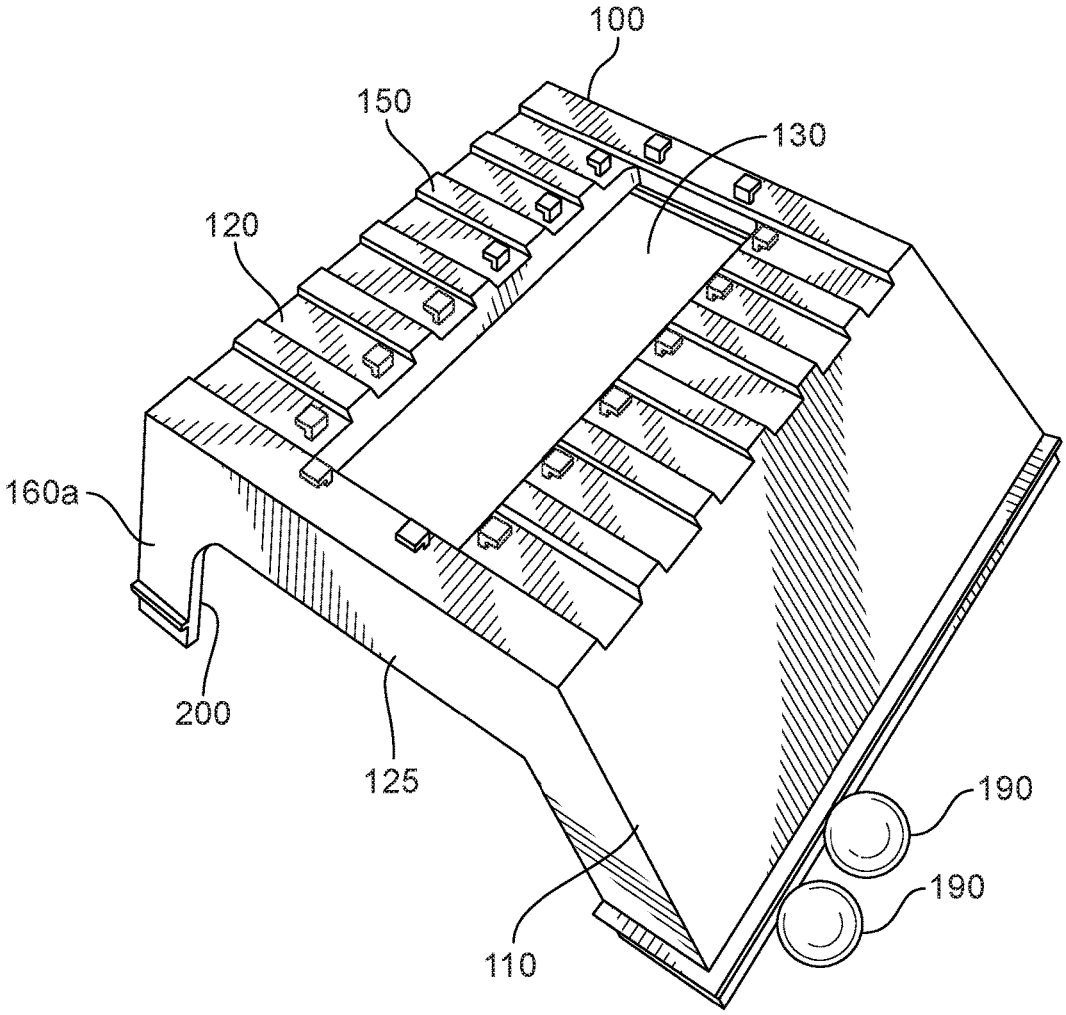
FIG. 5 is a perspective view of two angled boards according to an exemplary embodiment of the present disclosure.

FIG. 5 is a perspective view of two angled boards according to an exemplary embodiment of the present disclosure. As shown in FIG. 5, in some exemplary embodiments, the angled board 100 can be made so that the top board 120, ridges 150, slanted board 110, base 125, and legs 160*a*, 160*b* can be integral with each other. The angled board 100 and its components can be made of plastic or other similar material. This can allow for manufacturing of the angled board 100 in a single mold. The cutout 130 can be provided so the net 140 can be attached to the angled board 100 after. One or more hooks 165 can be provided along the top board 120 as shown as well as the sides 125 to attach a net 130 (not shown). The sides of the base 125 and legs 160*a*, 160*b* can flare outward away from the top board 120 in a direction towards the ground, allowing the angled board 100 to be stackable on top of another angled board 200, for ease of packaging and storing. In some exemplary embodiments, a package can be provided having two angled boards 100, 200 and one or more balls 190 with the ability to bounce on the surfaces of the angled boards.

Figure 6:
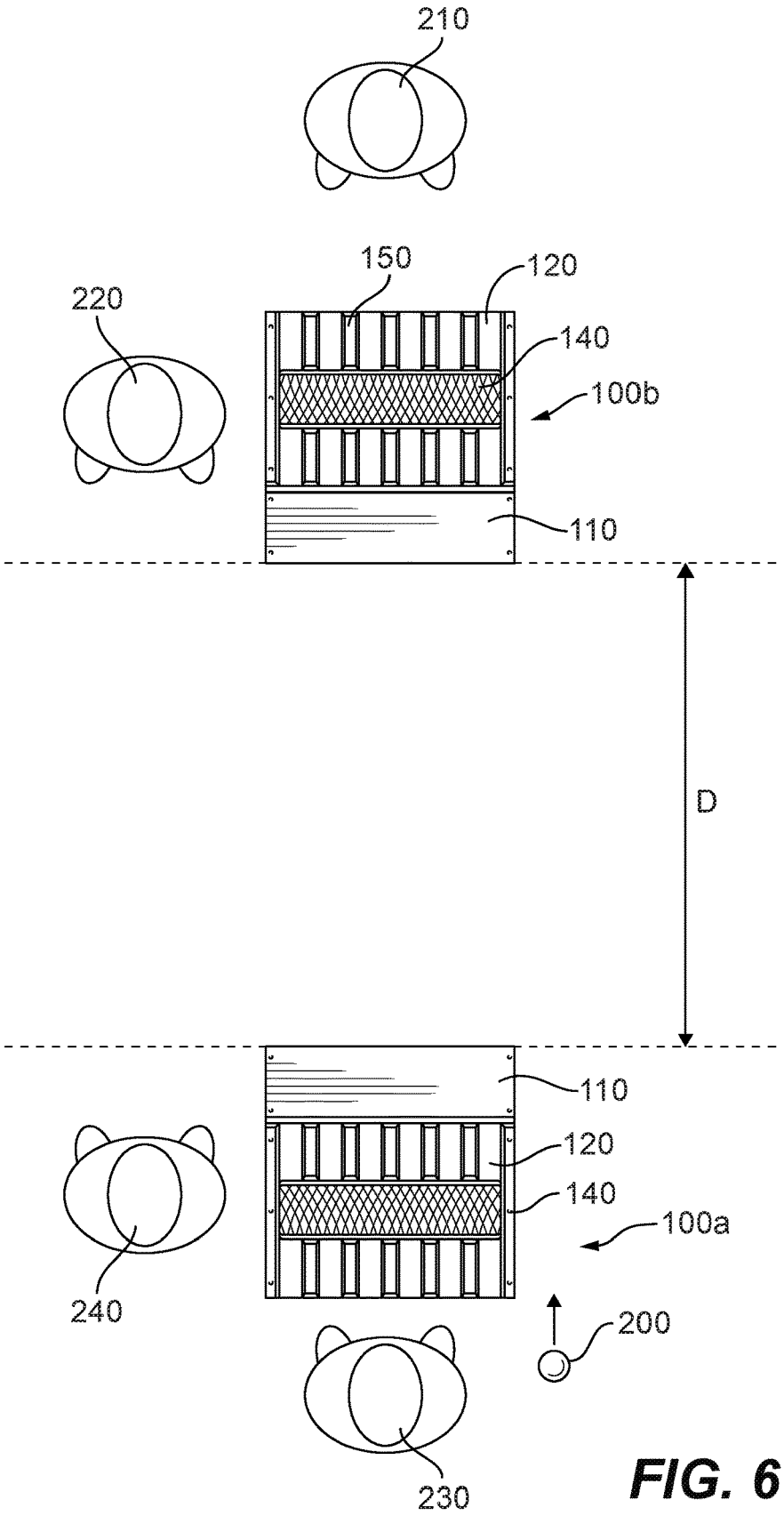
FIG. 6 is an illustration of a method of playing a game using the angled board according to an exemplary embodiment of the present disclosure.

FIG. 6 is an illustration of a method of playing a game using the angled board according to an exemplary embodiment of the present disclosure. In some exemplary embodiments, two opposing angled boards 100*a* and 100*b* can be used facing each other (e.g., the slanted boards 110 facing each other), where the two boards 100*a* and 100*b* are separated by a distance D, which can be measured by the front of one board 100*a* to the front of the other board 100*b*. The distance between the boards 100*a* and 100*b* can be based on skill level, and can range from 1 foot to approximately 100 feet, or as long as players prefer, and the exemplary embodiments of the present disclosure are not limited to any particular distance. In some exemplary embodiments, the distance D can be 18 feet for advanced play, 15 feet for standard play, and 12 feet for beginner/junior play.

A ball 200 can be used, which can be the size of a racquetball and is not limited to any particular size or material. The ball 200 can have bouncing characteristics, and can be light for throwing and easy to grip with a hand for maneuvering, aiming, throwing and catching. In some exemplary embodiments of the present disclosure, two balls can be used by each team for each particular "turn" as described below. In some exemplary embodiments of the present disclosure, two balls can be one color for one team and two balls can be another color for the other team.

Players can decide who goes first by either playing "odds or evens" or flipping a coin, or any procedure to determine a team that starts. The team that wins can go first. After a first round, the team with the higher score can go first for the next round. In the event the score is tied after any round, the team that started the previous round can go first in the next round.

In some exemplary embodiments of the present disclosure, play can consist of four players 210, 220, 230 and 240, divided into teams of two, although any number or combination of players is contemplated. Members of the same team can stand at opposite goals. For example, as shown in FIG. 5, players 210 and 230 can be on the same team, and players 220 and 240 can be on the same team. Teammates can alternate throwing, catching, and stealing the balls, as will be described below.

In the example shown in FIG. 5, player 230 is the "shooter", player 210 is the "playmaker" and player 240 is the "stealer". Player 220 (during players 210's and 230's turn) can stand to the side of the angled board 100*b* or can leave the area, and may not be needed. Player 230 (the shooter) can throw the ball 200 into the net 140 of the opposing angled board 100*b* in an attempt to score points. A toss directly into the net 140 (or "goal") can result in a certain number of points, such as three points, which can be considered a "triple." If the shooter 230 misses the net 140, the ball 200 can hit the slanted board 110 or any portion of the top board 120. The player 210 (the playmaker) can be a catcher, and can catch the ball tossed by the shooter for a certain number of points, such as one point, if it bounces of any part of the angled board 100*b*. The ball can be caught in the air by the playmaker, to obtain a certain number of points, such as one point. A one point play can be known as a "single." If the ball 200 hits the top board 120 or hits any ridge 150 or the walls of the ridges 150, it can bounce in any particular direction based on the dimensions and shape of the top board 120 and/or ridges 150. If shooter 230 misses 100*b* completely or when the ball hits the angled board 100 and hits the ground without be caught by a player (such as the playmaker or stealer), the ball 200 is considered a dead ball and no points may be awarded. After one team throws their number of balls (such as two balls), the opponents now have a turn to throw their own balls to score points. If the ball 200 hits the slanted board 110, it can bounce backwards to the direction of the shooter.

In some exemplary embodiments of the present disclosure, the opponents can have a chance to earn additional tosses if they can catch the ball on a fly from a rebound off the angled board 100*b*. This can give the opponent the potential of having one or two (or more if more balls are used) additional shots by stealing your opponent's tosses. Steals are unlimited and can happen multiple times in one round. For example, one team may steal a toss from an opponent, only to have their toss stolen back again. In the exemplary embodiments of the present disclosure shown in FIG. 5, player 240 can be a stealer. If the ball 200 bounces off the slanted board 110 or the top board 120, the stealer 240 can catch the ball for a "steal" and can have an extra turn once their turn is up, or can take away a turn from an opponent. In some embodiments, a "steal" can be points for the opposing team (the team the stealer 240 is on), such as one or two points.

Various other rules can be utilized to provide a game using the exemplary embodiments of the angled board 100. For example, the shooter 230, playmaker 210 or stealer 240 (or player 220) may not touch the board in any way during a player's turn. The playmaker 210 can move anywhere within a playing area to catch a ball, including in front of the angled board 100*b*. Partners may not be allowed to swap ends in the middle of a game (such as players 240 and 220, or players 210 and 230). If the teams are playing in a "best-of" series, players can switch ends after the completion of a game.

Each game can be played to a certain number of points, such as 15 points, and a team can achieve an exact score of 15 points to win, except in a case of overtime. A team who holds the lead going into each round can be the first to shoot. The last to shoot can depend on how many steals take place in a given round. A round can be considered complete when all four balls (or other amount of balls decided by the teams for each turn) are either played for a score or dead. A score can be considered a single (one point) or a triple (three points). A ball can be considered dead when the ball 200 misses the angled board 100 completely and hits the ground, or when the ball hits the angled board 100 and then hits the ground without being caught by a player (such as the playmaker or stealer). If a team hits 5 triples in a row in a game to 15, this can be considered a "perfect game."

All games can end at the completion of a round, unless it is mathematically impossible for an opponent to reach the number of points for victory, such as 15 points. For example, if one team scores 15 and the other team has 6 points but still has two shots left, the game will be considered over since even two triples will only bring that teams score to 12. Games may not be decided by sudden death unless a game goes into 21 point overtime, as described below.

In some exemplary embodiments of the present disclosure, since a team must score a certain number of points to win, such as exactly 15 points, if a given throw results in points that raise a team's total score above 15, that ball can be considered dead and that player's turn can be over. The team can forfeit the rest of their turn on that round and attempt to score exactly 15 points in the next round. If a team reaches 15 points on the first throw of their turn, they may simply toss the remaining ball(s) to their teammate to finish their turn or forfeit their remaining throw(s) on that turn.

If both teams reach 15 points in the same number of rounds (or any number of points previously determined by the players for victory), the game can be extended to overtime. The first team to shoot in overtime can be the team who went first at the beginning of the game. In a first overtime, teams can play to a score of 21, or other such score. The first team to score 21 exactly at the end of a round can be the winner. As in regulation, teams can score the exact number required for victory, such as exactly 21 points. If teams are still tied at 21 at the completion of a round, teams will go to a second overtime which can be played similar to the first overtime, or "sudden death" overtime. In sudden death, the game will be played one round at a time. The first team to outscore the other team in any round can be declared the winner. For example, if team #1 scores a total of 2 points in the first round, and team #2 scores a total of 4 points in the first round, the game can be over as a victory for team #2. In a situation where teams are tied at the end of the round, another round of overtime can begin, which can be similar to the previous overtime(s) or sudden death overtime.

Other procedures can be provided to enforce the rules. For example, if a player purposely interferes with the playmaker, they may succeed a point to their opponents. If it is incidental interference, teams can come to a mutual agreement and consider if a do over is warranted. If the odd man out (e.g., player 220) not playing interferes with play but the playmaker still makes the catch, the point can be considered valid. For instance, if a ball bounces off the board thrown by player 230, deflects off the odd man out (e.g., player 220) and is caught by the playmaker, the point can still count for that team. If the ball is dropped after deflecting off the odd man out, the interference point shall still be rewarded unless teams mutually agree to a redo. If the stealer 240 interferes with the shooter 230 while the shooter 230 is tossing the ball, the shooter can be permitted to redo that toss. In tournament play, if a player is interfered with by a player from another game, a do over can be permitted. In backyard play, if a player is interfered with another person who is not a participant of the game, a do over can also be permitted.

For the shooter (e.g., player 230), a legal throw can either be an overhand toss or an underhand toss to the angled board 100*b* on an opposite side of the distance D. The shooter can be standing behind the game board 100*a* for a legal shot. Leaning over the board 100*a* can be allowed assuming the shooters two feet are behind the angled board 100*a* they are standing behind. When a throw is deemed illegal, a foul can result in a loss of turn and no points will be rewarded.

For the playmaker (e.g., player 210) that is the shooter's teammate, the playmaker can do whatever it takes to catch the ball 200. However, the ball 200 may only be caught after bouncing off any part of the angled board 100*b* after the shooter throws it. Playmakers can typically stand several feet behind the angled board 100*b* that the shooter is trying to throw the ball 200 into, to put them in a good position to make a play on a ball that is bounced off the game board 100*b*. The playmaker can stand anywhere, and can preferably stand anywhere they prefer as long as they are behind their own board 100*a*.

The stealer (e.g., player 240) can be required to have at least one foot behind the front of the board 100*a*. The stealer can have at least one foot remain behind the front of the board until the shooter 230 fully releases the toss. Once the shooter 230 has released the toss, the stealer 240 can proceed to a practical position to catch and complete a steal after or if it bounces off the angled board 100*b*. The shooter 230 may not throw a second ball while the stealer 240 is in between the two boards 100*a* and 100*b*. As long as the stealer is not between the two boards 100*a* and 100*b*, the shooter 230 may resume and take their second or next shot. A repeat of a turn may not be permitted when a stealer is considered sleeping or not in position when it is their turn to steal the ball.

At any time during a game, three out of four people can be involved on every toss. The player who is not currently involved in the play (e.g., player 220), must make an effort to stay clear of the action by standing away from the playing area and giving the playmaker enough space to make a play on the ball.

Various scoring procedures and rules can be provided. For example, a single can be one point when a playmaker catches a teammate's toss after the ball bounces off the board. A triple can be three points once the shooter tosses the ball directly into the goal or net. A single and/or steal can be accomplished if the ball is caught off a bounce of any part of the game board. For example, if the bail 200 hits the perimeter of the goal and caroms back, the stealer can still make a play on it and go for the steal. In a similar manner, if the ball hits any part of the board causing the ball to bounce straight up, the playmaker can still catch it for a point. The playmaker and stealer may compete for the ball.

If the ball successfully lands below the surface of the board within the goal, the score can count even if the ball does not rest safely in the net. If the bail rattles around on the edges of the goal or the ball hits the perimeter of the goal, but does not sink below the surface of the board, it may not be considered a triple or a goal. However, the ball may still be caught on a fly and count as a single.

Various other considerations can also be addressed in the exemplary applications described according to the exemplary embodiments of the present disclosure. For example, various materials may be used to construct the elements described in the figures. For example, the board or any of its parts can be made of any wood, plastic, metal, sheet metal, paper, cardboard, composites, or a combination of such materials. The angled board 100 can be constructed of a material to float on water, allowing play in a pool or other water body. The board or any of its parts can be made of a glow-in-the-dark material, such as plastic, that can glow for nighttime play. The board can be made of glass (e.g., fiberglass), and illumination elements can be provided within the board for nighttime play. Glow-in-the-dark accessories, such as glow-in-the-dark balls, can be provided for play with the board, as well as a glow-in-the-dark net. An audible indicator can be provided for when the ball enters the net. The net can have sensors for detecting whether a ball has entered the net, or a sensor can be provided between the top board 210 and the net 140 to detect motion such as a ball crossing such boundary. Variations of sounds can be provided depending on where the ball hits the angled board 100, such as top board 120, slanted board 110 or net 140. A visual signal can also be provided, such as a light when the ball enters the net or any part of the angled board 100. Any combination of audio and visual signals can be provided. A scorekeeper can be built into the angled board 100 to keep track of scoring, which can be manual or electronic, with a visual indicator of the score.

Various sizes and dimensions of the elements can be provided, as well as shapes for the board and each of its components. A larger size can be provided for outdoor use, and a smaller size can be provided for tabletop use, with a corresponding ball size as appropriate for indoor or outdoor use. The ball can be made of any material that can provide bouncing characteristics off the angled board. In some exemplary embodiments, a single angled board can be used that is provided between opponents. The cutout portion 130 can be adjustable in some exemplary embodiments to allow for greater difficulty in the size of the goal. The amount of players for each team can be variable, such as more than one playmaker, shooter, or stealer. In some exemplary embodiments, a measuring tape can be built into the angled board to determine a distance between the angled boards for play. Various scoring rules and number of teammates can be provided, and the exemplary embodiments of the present disclosure are not limited to any of the exemplary embodiments described herein. In some exemplary embodiments, a package can be provided comprising two angled boards and one or more balls with the ability to bounce.

The foregoing merely illustrates the principles of the disclosure. Various modifications and alterations to the described embodiments will be apparent to those skilled in the art in view of the teachings herein. It will thus be appreciated that those skilled in the art will be able to devise numerous apparatuses, arrangements, manufacture and methods which, although not explicitly shown or described herein, embody the principles of the disclosure and are thus within the spirit and scope of the disclosure. The disclosures of all documents and publications cited herein are hereby incorporated herein by reference in their entireties.

What is claimed is:

1. An angled board, comprising:

a base;

a top surface provided on the base and having a receptacle, wherein the top surface is configured to allow a ball to bounce off the top surface;

a slanted board provided proximate to a first end of the top surface, the slanted board being provided at an angle and extending downward with respect to the top surface;

a first plurality of polygonal ridges provided between a first side of the top surface to an opposite second side of the top surface; and a second plurality of polygonal ridges provided between the first side of the top surface to the opposite second side of the top surface;

wherein the receptacle is provided from the first side of the top surface to the opposite second side of the top surface and between the first plurality of polygonal ridges and the second plurality of polygonal ridges, separating the first plurality of polygonal ridges from the second plurality of polygonal ridges; and wherein the first plurality of polygonal ridges extend in a same direction lengthwise as the second plurality of polygonal ridges.

2. The angled board of claim 1, wherein the top surface is approximately parallel to a flat ground surface when the angled board is placed on the flat ground surface.

3. The angled board of claim 2, wherein the first plurality of polygonal ridges and the second plurality of polygonal ridges extending upward from the top surface.

4. The angled board of claim 3, wherein the first and second plurality of polygonal ridges have a flat top portion and angled walls around a perimeter of the ridges between the flat top portion and the top surface.

5. The angled board of claim 4, wherein the first and second plurality of polygonal ridges each have at least five ridges.

6. The angled board of claim 2, further comprising:

a net provided under the receptacle and connected to the angled board.

7. The angled board of claim 3, wherein each of the first and second plurality of polygonal ridges have an angled left wall and an angled right wall that extend upward from the top surface to a flat top portion of the polygonal ridge.

8. The angled board of claim 1, wherein the angle is approximately 135 degrees.

9. The angled board of claim 2, wherein the base comprises:

one or more support legs supporting the top board at a second end opposite the first end of the top surface.

10. The angled board of claim 1, wherein the top surface, slanted board and base comprise a single unitary piece.

11. The angled board of claim 10, wherein the top surface, slanted board and base are made of plastic.

12. A package comprising:

a first angled board comprising:

a base;

a top surface on the base having an upper portion at a first end, a lower portion at a second end and a net provided under a receptacle between the upper and lower portions and separating the upper and lower portions from each other;

a first plurality of polygonal ridges provided along a width of the upper portion and a second plurality of polygonal ridges provided along a width of the lower portion of the top surface, the first and second polygonal ridges extending upward from the top surface;

a slanted board provided at the second end of the top surface, the slanted board being provided at an angle with respect to the top surface; and two support legs provided at a second end of the top surface;

wherein the top surface and the slanted board are configured to allow a ball to bounce off their surface;

wherein the first plurality of polygonal ridges extend in a same direction lengthwise as the second plurality of polygonal ridges; and a second angled board comprising:

a base;

a top surface on the base having an upper portion at a first end, a lower portion at a second end and a net provided under a receptacle between the upper and lower portions and separating the upper and lower portions from each other;

a first plurality of polygonal ridges provided along a width of the upper portion and a second plurality of polygonal ridges provided along a width of the lower portion of the top surface, the first and second polygonal ridges extending upward from the top surface;

a slanted board provided at the second end of the top surface, the slanted board being provided at an angle with respect to the top surface; and two support legs provided at a second end of the top surface;

wherein the top surface and the slanted board are configured to allow a ball to bounce off their surface;

wherein the first plurality of polygonal ridges extend in a same direction lengthwise as the second plurality of polygonal ridges; and one or more balls configured to bounce off the top surfaces and the slanted boards of the first and second angled boards.

13. The package of claim 12, wherein each of the first and second plurality of polygonal ridges on the first angled board have an angled left wall and an angled right wall that extend upward from the top surface of the first angled board, and each of the first and second plurality of polygonal ridges on the second angled board have an angled left wall and an angled right wall that extend upward from the top surface of the second angled board.

14. The package of claim 12, wherein each of the first and second plurality of polygonal ridges on the first angled board extend in a direction perpendicular to the slanted board of the first angled board, and each of the first and second plurality of polygonal ridges on the second angled board extend in a direction perpendicular to the slanted board of the second angled board.

15. An angled board, comprising:

a base having a support;

a top surface on the base having a first portion, a second portion and a receptacle between the first portion and second portion separating the first portion and second portion from each other, wherein the top surface is configured to allow a ball to bounce off the top surface;

a slanted board provided proximate to a first end of the top surface, the slanted board being provided at an angle and extending downward with respect to the top surface;

a first plurality of polygonal ridges provided on and extending across a width of the first portion of the top surface; and a second plurality of polygonal ridges provided on and extending across a width of the second portion of the top surface;

wherein each of the first plurality of polygonal ridges are parallel to each other and each of the second plurality of polygonal ridges are parallel to each other.

16. The angled board of claim 15, wherein the first and second plurality of polygonal ridges extend upward from the top surface.

17. The angled board of claim 16, wherein the first and second plurality of polygonal ridges have a flat top portion and angled walls around a perimeter of the ridges between the flat top portion and the top surface.

18. The angled board of claim 16, wherein each of the first and second plurality of polygonal ridges have an angled left wall and an angled right wall that extend upward from the top surface.

19. The angled board of claim 16, wherein the angle of the slanted board with respect to the top surface is approximately 95 degrees to approximately 170 degrees, such that the rear portion of the top surface is higher than the front portion of the top surface when the angled board is placed on a flat ground surface.

20. An angled board, comprising:

a base;

a top surface provided on the base and having a receptacle, wherein the top surface is configured to allow a ball to bounce off the top surface;

a first plurality of elongated ridges provided between a first side of the top surface to an opposite second side of the top surface; and a second plurality of elongated ridges provided between the first side of the top surface to the opposite second side of the top surface, wherein each of the first and second plurality of elongated ridges have a left wall and a right wall that extend upward from the top surface;

wherein the receptacle is provided from the first side of the top surface to the opposite second side of the top surface and between the first plurality of elongated ridges and the second plurality of elongated ridges, separating the first plurality of elongated ridges from the second plurality of elongated ridges; and wherein each of the first plurality of polygonal ridges are parallel to each other and each of the second plurality of polygonal ridges are parallel to each other.

21. The angled board of claim 20, wherein the left wall and the right wall are angled with respect to the top surface and a flat top portion of the first and second plurality of elongated ridges.

22. The angled board of claim 15, wherein each of the first and second plurality of elongated ridges extend in a direction perpendicular to the slanted board.

* * * * *